US007502584B2

(12) United States Patent
Takeyama

(10) Patent No.: US 7,502,584 B2
(45) Date of Patent: Mar. 10, 2009

(54) IMAGE FORMING APPARATUS SENSING DISPLACEMENT OF AN INTERMEDIATE IMAGE TRANSFER BODY

(75) Inventor: Yoshinobu Takeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 166 days.

(21) Appl. No.: 11/543,883

(22) Filed: Oct. 6, 2006

(65) Prior Publication Data

US 2007/0086813 A1 Apr. 19, 2007

(30) Foreign Application Priority Data

Oct. 18, 2005 (JP) ..... 2005-302465

(51) Int. Cl.
*G03G 15/01* (2006.01)
*G03G 15/16* (2006.01)

(52) U.S. Cl. ..... 399/302; 399/301

(58) Field of Classification Search ..... 399/301, 399/302, 308, 162, 394, 395, 396; 347/116; 198/810.01, 810.03
See application file for complete search history.

(56) References Cited

U.S. PATENT DOCUMENTS 5,510,877 A * 4/1996 deJong et al. ..... 399/38
2006/0280530 A1* 12/2006 Andoh ..... 399/301

FOREIGN PATENT DOCUMENTS

| | | | |
|---|---|---|---|
| JP | 8-137351 | | 5/1996 |
| JP | 09-175687 | A * | 7/1997 |
| JP | 3209451 | B2 | 7/2001 |
| JP | 3275627 | B2 | 2/2002 |
| JP | 2002-287527 | | 10/2002 |

* cited by examiner

*Primary Examiner*—Sophia S Chen
(74) *Attorney, Agent, or Firm*—Oblon, Spivak, McClelland, Maier & Neustadt, P.C.

(57) ABSTRACT

An image forming apparatus of the present invention includes a plurality of belt position sensors adapted to sense the position of an intermediate image transfer belt in a direction perpendicular to the direction of movement of the belt each. The belt position sensors are located between rollers over which the intermediate image transfer belt is passed at positions different from each other in the plane of the belt in the direction of movement. A displacement calculator produces a difference between sensed values output by the belt position sensors at a plurality of desired belt positions of the intermediate image transfer belt and sequentially adds the differences to a difference between sensed values output from the belt position sensors at belt positions different from the above desired belt positions for thereby determining a displacement of the belt in the direction perpendicular to the direction of movement of the belt.

10 Claims, 9 Drawing Sheets

IMAGE FORMING APPARATUS SENSING DISPLACEMENT OF AN INTERMEDIATE IMAGE TRANSFER BODY

BACKGROUND OF THE INVENTION

1. Field of the Invention

The present invention relates to an image forming apparatus of the type using an intermediate image transfer body and more particularly to an image forming apparatus capable of sensing the displacement or shift of an intermediate image transfer body that may occur in a direction perpendicular to the direction of movement of the intermediate image transfer body during operation.

2. Description of the Background Art

A copier, printer or similar image forming apparatus of the type using an intermediate image transfer belt, photoconductive belt, image transfer belt or similar endless belt is conventional. The problem with such an endless belt is that the belt is likely to be shifted or meander in a direction perpendicular to the direction of movement due to the turn thereof. In a color image forming apparatus, for example, any displacement of the endless belt in the above direction causes toner images of different colors to be brought out of register, thereby degrading image quality. In order to solve this problem, a driver for driving the endless belt, particularly one included in a color image forming apparatus, must be configured to adequately control the displacement or the meander of the belt.

Some different methods have heretofore been proposed for controlling the displacement of the above endless belt, as will be described hereinafter. Japanese Patent Laid-Open Publication No. 2002-287527, for example, teaches that by controlling the inclination of an adjust roller, which causes an endless belt passed over it to turn, in proportion to the amount of shift of the belt, it is possible to control the shift with high accuracy. With this scheme, however, it is impossible to determine the amount of shift by taking account of the irregularity of the edge of the belt.

Japanese Patent Laid-Open Publication No. 8-137351 discloses a mechanism adapted for adjusting a position where a drive roller and the edge of an endless belt passed over it contacts each other. This mechanism, however, simply determines whether or not the belt is shifted and cannot execute control in accordance with the amount of shift.

Further, Japanese Patent No. 3,275,627 proposes a belt shift control device using a shift sensing member contacting the widthwise edge of an endless belt for sensing the shift of the belt. The problem with the shift sensing member taught in the above document is that it cannot respond to shifts occurring at fine pitches.

Technologies relating to the present invention are also disclosed in, e.g., Japanese Patent No. 3,209,451.

SUMMARY OF THE INVENTION

It is an object of the present invention to provide an image forming apparatus capable of accurately determining the displacement or amount of shift or the amount of meander of an endless belt in a direction perpendicular to the direction of movement of the belt without regard to the accuracy of the edge configuration of the belt or errors in the configuration of marks adapted to be sensed, realizing image formation free from noticeable color shifts in the main scanning direction.

An image forming apparatus for forming a superposed image by transferring an image formed on an image carrier to an intermediate image transfer belt of the present invention includes belt position sensors configured to sense the position of the belt in a direction perpendicular to the direction of movement of the belt each. The belt position sensors are located between rollers over which the intermediate image transfer belt is passed at positions different from each other in the direction of movement in the plane of the intermediate image transfer belt. A displacement calculator produces a difference between sensed values output by the belt position sensors at a plurality of desired belt positions of the intermediate image transfer belt and then sequentially adds consecutive differences to a difference between sensed values output from the belt position sensors at belt positions different from the above belt positions for thereby determining a displacement of the belt in the direction perpendicular to the direction of movement of the belt.

Also, an image forming apparatus for forming a superposed image on an intermediate image transfer belt by transferring images formed on a plurality of image carriers to the belt one above the other of the present invention includes belt position sensors configured to sense the position of the belt in a direction perpendicular to the direction of movement of the belt each. The belt position sensors are located at or near positions where the image carriers and intermediate image transfer belt contact each other. A displacement calculator determines a difference between values output from the belt position sensors with respect to a plurality of desired belt positions of the intermediate image transfer belt and sequentially adds consecutive difference to a difference between values output from the belt position sensors with respect to other belt positions different from the above belt positions beforehand for thereby determining a displacement of the intermediate image transfer belt in the direction perpendicular to the direction of movement of the belt.

Further, an image forming apparatus for forming a superposed color image on an intermediate image transfer belt, which makes one turn, by transferring images formed on a plurality of image carriers to the belt one above the other of the present invention includes belt position sensors configured to sense a position of the belt in a direction perpendicular to the direction of movement of the belt each. The belt position sensors are located at or near positions where the image carriers and intermediate image transfer belt contact each other. A displacement calculator determines a difference between values output from the belt position sensors with respect to a plurality of desired belt positions of the intermediate image transfer belt and sequentially adds consecutive difference to a difference between values output from the belt position sensors with respect to other belt positions different from the above belt positions beforehand for thereby determining a displacement of the belt in the direction perpendicular to the direction of movement of the belt. A controller controls an image formation start position in the main scanning direction on each image carrier via a respective writing unit in accordance with the displacement of the intermediate image transfer belt determined with respect to the image carrier.

Furthermore, an image forming apparatus for forming a superposed color image on an intermediate image transfer belt, which makes a plurality of turns, by transferring images formed on a plurality of image carriers to the belt one above the other of the present invention includes belt position sensors configured to sense a position of the belt in a direction perpendicular to a direction of movement of the belt each. The belt position sensors are located at or near positions where the image carriers and intermediate image transfer belt contact each other. A displacement calculator determines a difference between values output from the belt position sensors with respect to a plurality of desired belt positions of the intermediate image transfer belt and sequentially adds consecutive differences to a difference between values output from the belt position sensors with respect to other belt positions different from the above belt positions beforehand for thereby determining a displacement of the belt in the direction perpendicular to the direction of movement of the belt. A storage stores displacements of the intermediate image transfer belt determined by the displacement calculator when the intermediate image transfer belt completes one turn. A controller controls an image transfer start position in the main scanning direction in accordance with the displacements stored in the storage.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
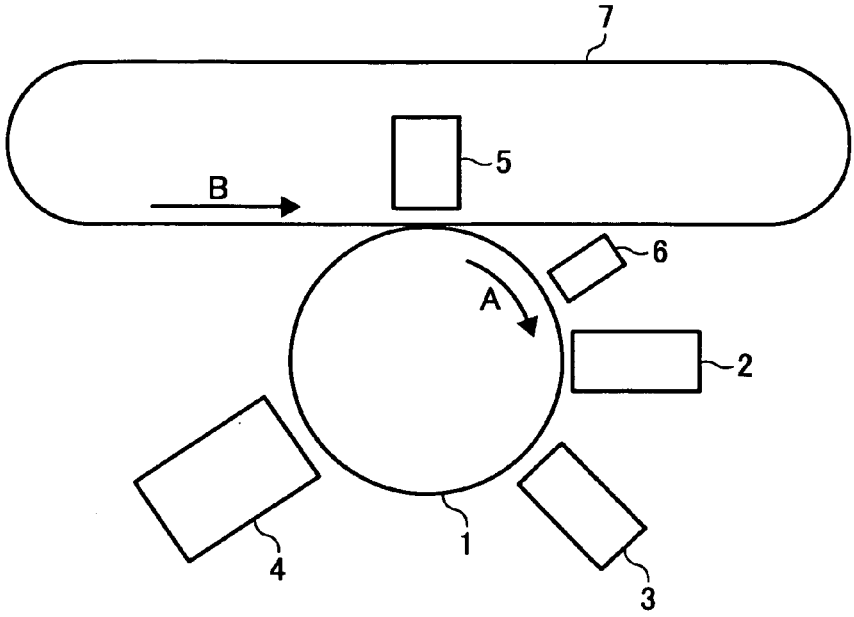
FIG. 1 is a view conceptually showing the basic configuration of an image forming apparatus to which the present invention is applied.

To better understand the present invention, the basic configuration of an image forming apparatus to which the present invention is applied will be described with reference to FIG. 1. As shown, the image forming apparatus includes a photoconductive drum or similar image carrier 1. A charger 2, a writing unit 3, a developing unit 4, an image transferring unit 5 and a drum cleaner 6 are arranged around the photoconductive drum (simply drum hereinafter) 1. An intermediate image transfer body 7 is positioned above the drum 1 and implemented as an endless belt by way of example. A mark, not shown, showing the reference position of the belt 7 is provided on the belt 7.

In operation, while the drum 1 is rotated in a direction indicated by an arrow A in FIG. 1, the surface of the drum 1 is uniformly charged by the charger 2. Subsequently, when a mark sensor or mark sensing means, not shown, senses the mark provided on the belt 7 which is being turned, the writing unit 3 starts exposing the charged surface of the drum 1 in accordance with image data to thereby form a latent image on the drum 1. The latent image thus formed is developed by the developing unit 4 to become a toner image and then transferred from the drum 1 to the belt 7 by the image transferring unit 5 at the position where the drum 1 and belt 7 contact each other. After such image transfer, the drum cleaner 6 is caused to remove toner left on the surface of the drum 1.

In a color or multiple-color mode, the developing unit 4, for example, is switched by switching means, not shown, in order to repeat the image forming process stated above a number of times corresponding to a desired number of colors. The resulting toner images of different colors are sequentially transferred from the drum 1 to the belt 7 one above the other, completing a color image. Subsequently, an image transfer roller, not shown, is brought into contact with the belt 7 to transfer the color image from the belt 7 to a paper sheet or similar recording medium conveyed to the position where the above roller contacts the belt 7. After the image transfer from the belt 7 to the paper sheet, the image transfer roller is released from the belt 7.

The paper sheet, thus carrying the color image thereon, is conveyed to a fixing unit to have the color image fixed thereby and then driven out of the apparatus body as a print. A cleaning blade, not shown, is brought into contact with the belt 7 over an area where the color image has been formed in order to remove toner left thereon and is then released from the belt 7.

The problem with the above configuration is that tension acting on the belt or intermediate image transfer body 7 varies due to the movement of the image transfer roller and cleaning blade into and out of contact with the belt 7, shifting the position of the belt 7 or causing the belt 7 to meander. This causes images of different colors to be brought out of register with each other to thereby lower the quality of the resulting color image.

In order to solve the above problem, the present invention more accurately determines the displacement, i.e., the amount of shift or that of meander of the belt 7 in the direction perpendicular to the direction of movement B of the belt 7 at an image transfer position and then controls the image forming timing of the writing unit 3 in accordance with the displacement thus determined.

Figure 2:
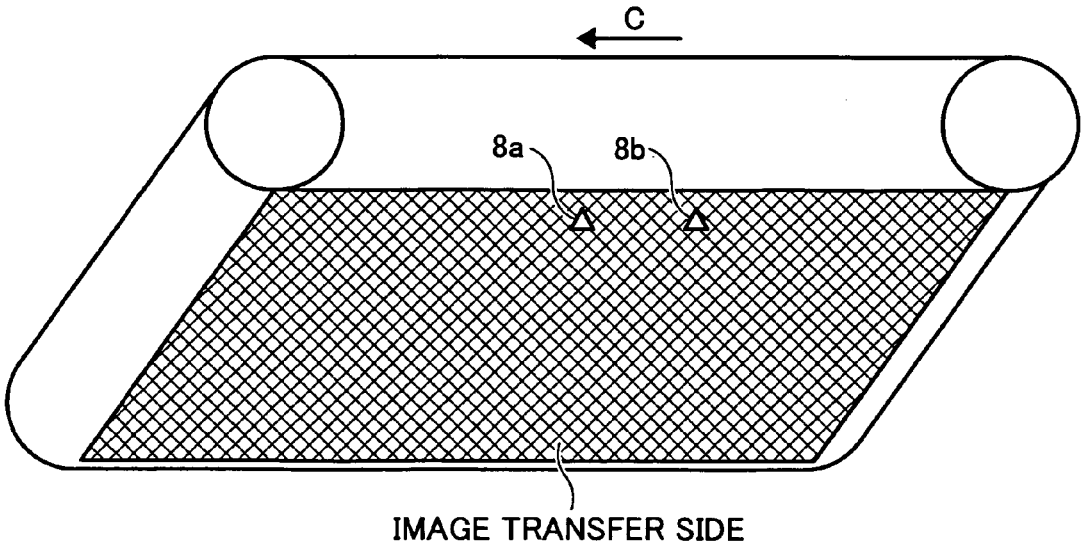
FIG. 2 is a view, as seen obliquely from the bottom, showing an intermediate image transfer belt included in a preferred embodiment of the image forming apparatus in accordance with the present invention.

FIG. 2 shows an endless, intermediate image transfer belt or intermediate image transfer body 7 included in a preferred embodiment of the image forming apparatus in accordance with the present invention, as seen obliquely from the underside or drum side. As shown, belt position sensors or belt position sensing means 8*a* and 8*b*, responsive to the edge of the belt 7 each, are located below the flat portion of the intermediate image transfer belt (simply belt hereinafter) 7, i.e., at the image transfer side at different positions from each other in a reference plane which is parallel to the direction of movement of the belt 7. The belt 7 is moved in a direction indicated by an arrow C in FIG. 2, i.e., from the belt position sensor 8*a* toward the belt position sensor 8*b*.

It is to be noted that the above belt position sensors 8*a* and 8*b* may alternatively be configured to sense a mark, a pattern or the like provided on the belt 7 instead of the edge of the belt 7 so long as they can determine a displacement of the belt 7 in the direction perpendicular to the direction of movement of the belt 7.

Figure 3:
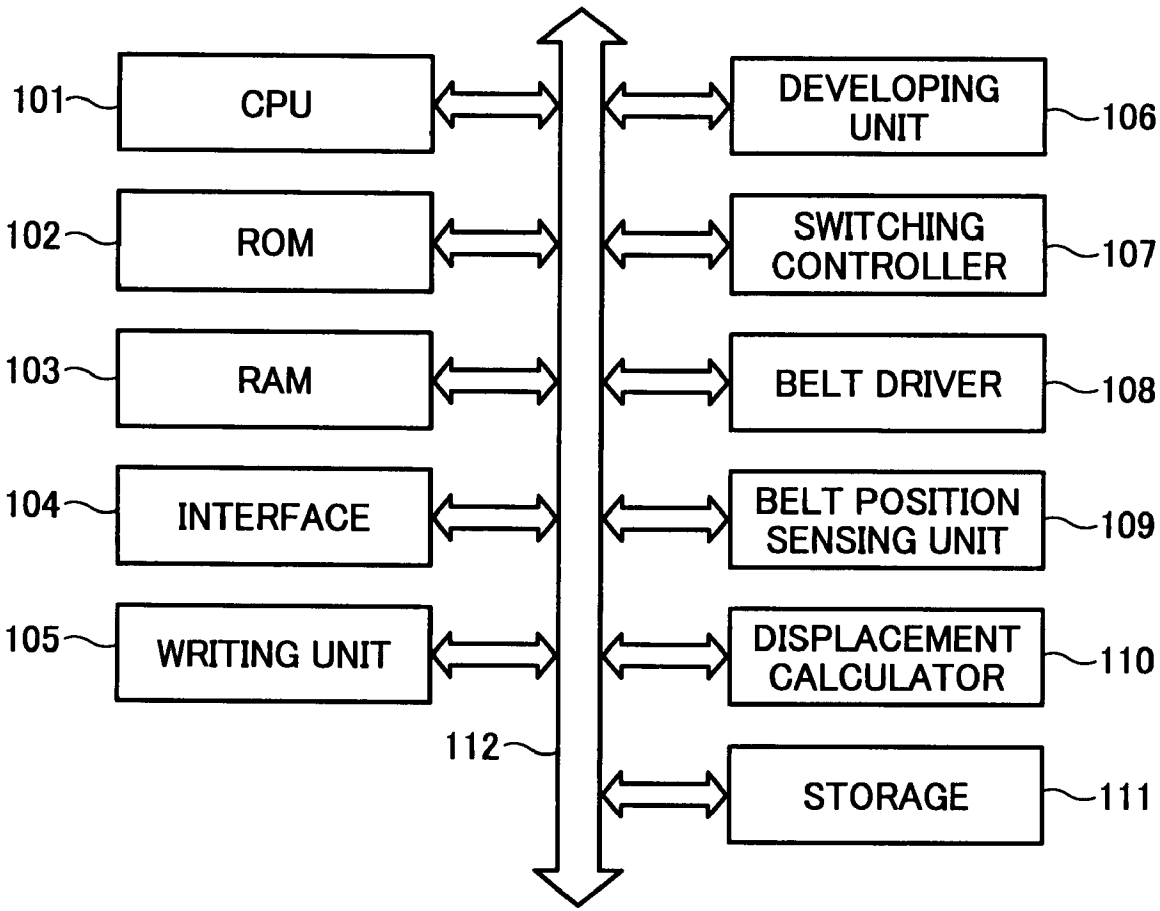
FIG. 3 is a block diagram schematically showing a control system included in the illustrative embodiment.

FIG. 3 is a schematic block diagram showing a control system included in the illustrative embodiment. As shown, the image forming apparatus, generally, includes a CPU (Central Processing Unit) 101, a ROM (Read Only Memory) 102 storing a control program to be executed by the CPU 101 and various data, a RAM (Random Access Memory) or work memory 103 adapted for temporarily storing image data to be processed and program to be executed, and an interface 104 adapted for interchanging data with an external unit via, e.g., Ethernet (registered trademark), a telephone line or a radio channel. The CPU 101, ROM 102 and RAM 103 constitute a controller in combination. A writing unit 105, a developing unit 106, a switching controller 107, a belt driver 108, a belt position sensing unit 109, a belt displacement calculator 110 and a storage 111 are connected to the controller by a bus 112.

In the above construction, the writing unit 105 and developing unit 106 respectively corresponds to the writing unit 3 and developing unit 4 shown in FIG. 1. The switching controller 107 is configured to control the switching of development, as will be described specifically later. The belt driver 108 is adapted to control the drive of the belt 7, FIG. 1. The belt position sensing unit 109 is adapted to sense the positions of the belt 7 in accordance with the output signals of the belt position sensors 8*a* and 8*b*, FIG. 2. The belt displacement calculator 110 is configured to calculate, by using calculations to be described in detail later, a displacement of the belt 7 on the basis of the positions of the belt 7 sensed by the belt position sensing unit 109. The storage 111 temporarily stores the displacement of the belt 7 thus determined by the belt displacement calculator 110.

Figure 4:
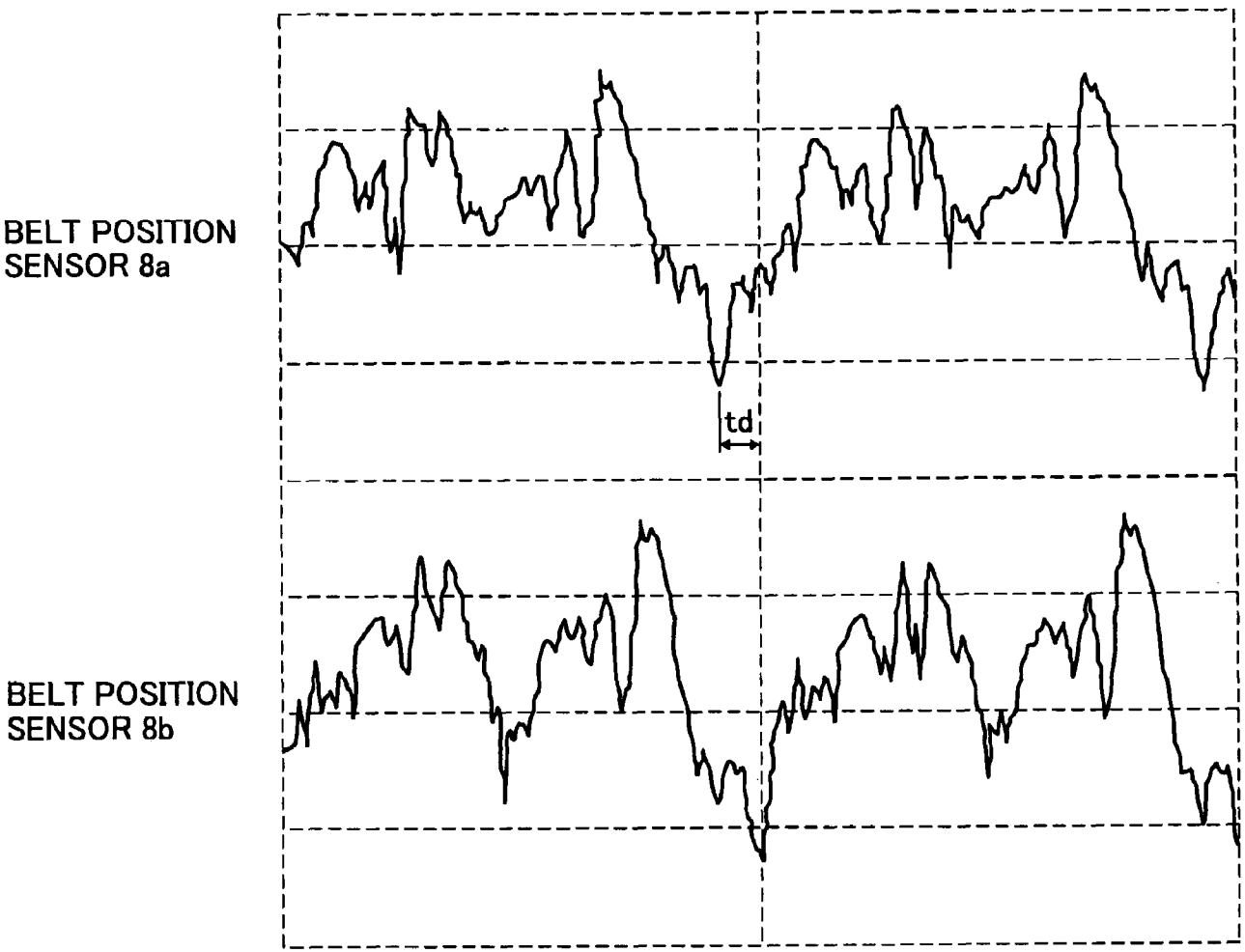
FIG. 4 is a timing chart showing specific displacements of a belt edge sensed by different belt position sensors while the intermediate image transfer belt is in movement.

FIG. 4 shows waveforms representative of specific displacements of the belt 7 sensed by the belt position sensors 8*a* and 8*b*, which start sensing the position of the belt 7 on sensing a reference mark provided on the belt 7 each. As shown, a displacement of the belt 7 substantially identical with a displacement sensed by the belt position sensor 8*a* is sensed by the belt position sensor 8*b* on the elapse of a period of time of td, which is necessary for a given point on the belt 7 to move from the belt position sensor 8*a* to the belt position sensor 8*b*. It will therefore be seen that the same portion of the belt 7 is displaced by substantially the same amount without regard to the sensing position because the meander component of the belt 7 during movement is buried in the irregularity component of the edge configuration of the belt 7.

Assume that a displacement delayed from a displacement a sensed by the belt position sensor 8*a* by the period of time td is a'. Then, by subtracting the above displacement a' from a displacement b actually sensed by the belt position sensor 8*b*, it is possible to determine a displacement or meander component of the belt 7 occurred during the movement of a given point on the belt 7 from the belt position sensor 8*a* to the belt position sensor 8*b* while canceling the irregularity of the belt edge. It follows that by determining a difference with respect to any desired point on the belt 7 with the above subtraction and then adding or subtracting it to or from a difference previously determined with respect to a neighboring point, it is possible to produce a meander component free from the influence of the irregularity of the configuration of the belt edge.

In light of the above, in the illustrative embodiment, two belt position sensors 8*a* and 8*b* are spaced from each other by a distance equal to a value produced by multiplying a pitch between nearby points on the belt 7 to be sensed by n which is an integer.

Figure 5:
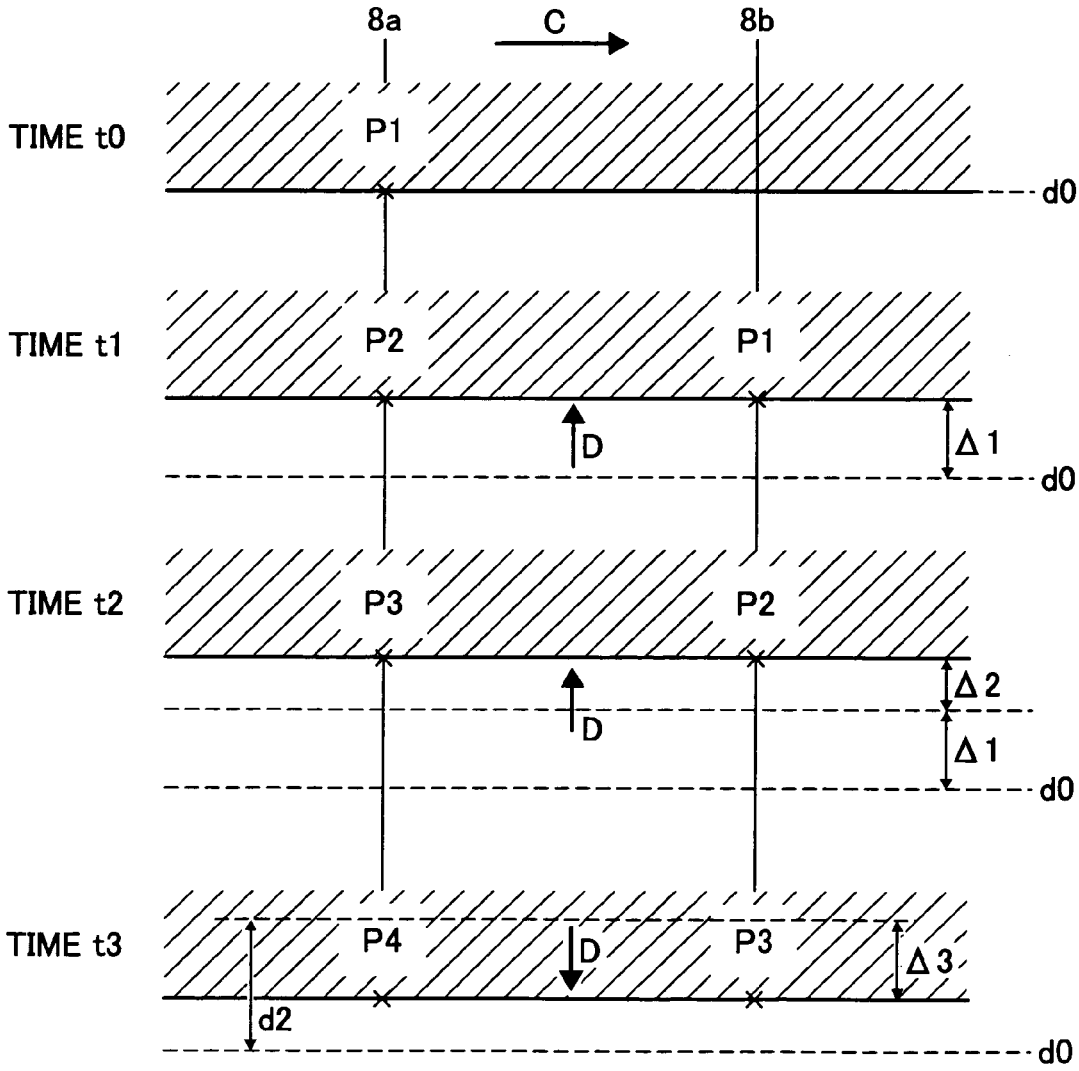
FIG. 5 shows specific positions of the belt edge, as seen from the top, sensed at consecutive sensing positions on the assumption that the distance between the belt position sensors and the pitch of points of the belt to be sensed are equal to each other.

First, assume that the above integer n is 1, i.e., the distance between the belt position sensors 8*a* and 8*b* is equal to the pitch of the points on the belt 7 to be sensed. FIG. 5 conceptually shows belt positions, or displacements, at consecutive sensing positions, as seen from the top of the belt edge portion, in the above condition. As FIG. 5 indicates, when a point P1 on the belt arrives at the sensing position of the belt position sensor 8*b*, a point P2 on the belt adjoining the point P1 is sensed by the belt position sensor 8*a*. In FIG. 5, an arrow D indicates a direction in which the belt is displaced while in movement. Further, assume that a position where the point P1 on the belt is sensed by the belt position sensor 8*a* at a time t0 is a reference position d0.

Under the above conditions, the belt is shifted upward as it moves in the direction C, and the points P1 and P2 are sensed by the belt position sensors 8*b* and 8*a*, respectively, at a time t1. By subtracting the value of the belt position sensor 8*a* output at the time to from the value of the belt position sensor 8*b* output at the time t1, it is possible to determine a displacement, i.e., an amount of meander Δ1 resulting from the shift of the point P1 on the belt. Because the distance between the belt position sensors 8*a* and 8*b* is as small as several centimeters, the portion of the belt edge between the belt position sensors 8*a* and 8*b* may be considered to be substantially parallel to the reference plane, which extends in the direction of movement of the belt, on the assumption that the above portion is free from irregularities. Therefore, it may be safely said that the point P2 on the belt sensed by the belt position sensor 8*a* at the time t1 is deviated by Δ1 from the reference position d0.

As shown in FIG. 5, assume that the belt is shifted further upward while in movement and that the point P2 and a point P3 on the belt are sensed by the belt position sensors 8*b* and 8*a*, respectively, at a time t2. Then, by subtracting the value of the belt position sensor 8*a* output at the time t1 from the value of the belt position sensor 8*b* output at the time t2, there is produced a displacement or amount of meander Δ2 of the point P2 resulting from the movement of the belt. Because the point P2 has already been shifted by Δ1 from the reference position do at the position of the belt position sensor 8*a*, a displacement d2 from the reference position d0 is equal to the sum of Δ1 and Δ2. At this instant, the point P3 is also shifted from the reference position d0 by d2 from the reference position d0 at the position of the belt position sensor 8*a*.

Subsequently, assume that the point P3 on the belt is shifted downward in FIG. 5 and that the point P3 and a point P4 on the belt are sensed by the belt position sensors 8*b* and 8*b*, respectively, at a time t3. Then, by subtracting the value of the belt position sensor 8*a* output at the time t2 from the value of the belt position sensor 8*a* output at the time t3, there is produced a displacement or amount of meander Δ3 of the point P3 resulting from the movement of the belt. Because the point P3 has already been shifted by d2 from the reference position d0 at the position of the belt position sensor 8*a*, a displacement d3 from the reference position d0 is equal to $d2+(-\Delta 3)=\Delta 1+\Delta 2-\Delta 3$. At this instant, the point P4 is also shifted from the reference position d0 by d3 from the reference position d0 at the position of the belt position sensor 8*a*. Such a procedure is repeated thereafter to determine consecutive displacements from a reference position.

Figure 6:
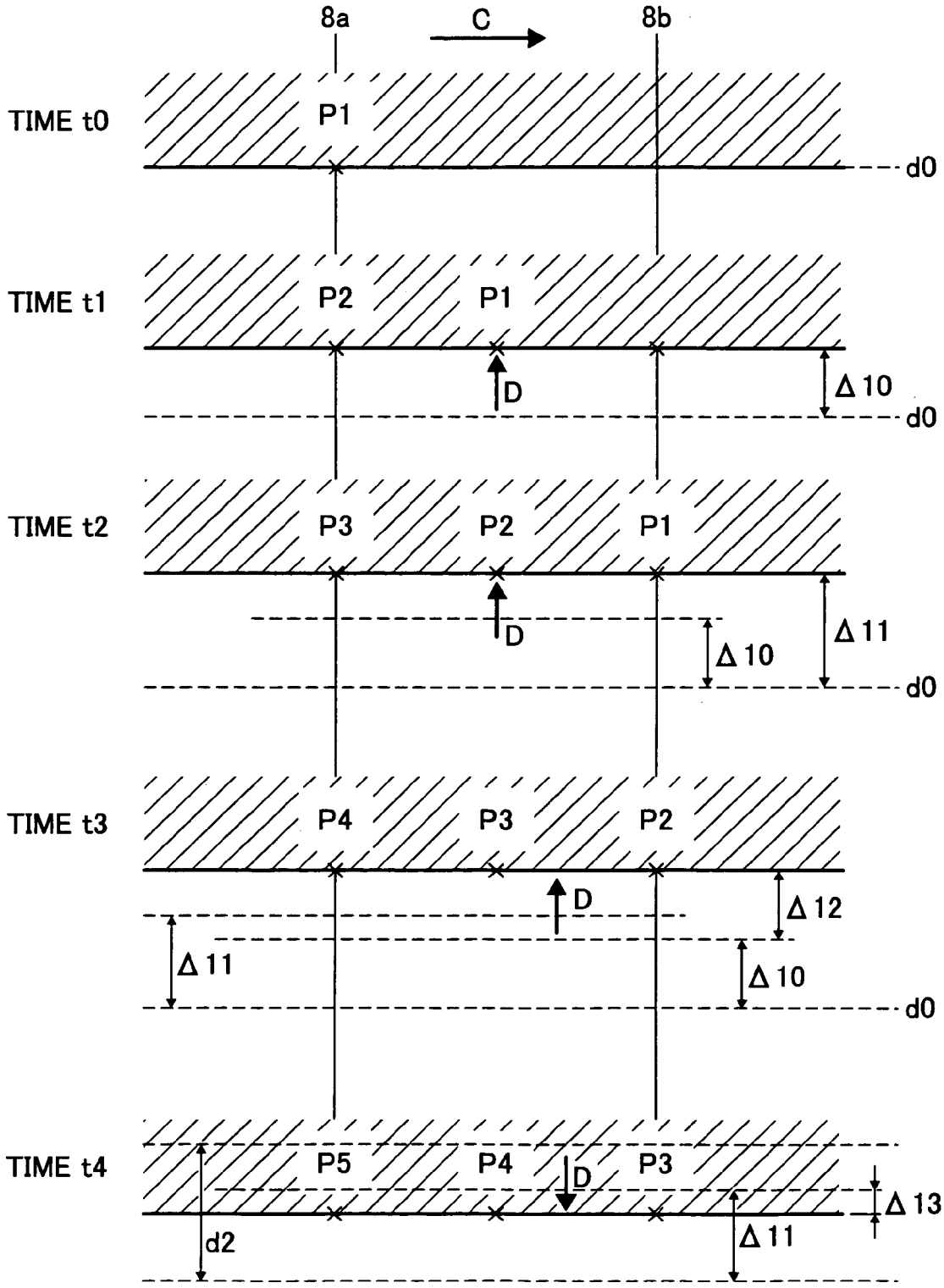
FIG. 6 shows specific positions of the belt edge, as seen from the top, sensed at consecutive sensing positions on the assumption that the distance between the belt position sensors is two times as great as the pitch of points of the belt to be sensed.

FIG. 6 conceptually shows another specific case wherein the distance between the belt position sensors 8*a* and 8*b* is two times as great as the pitch of the points on the belt to be sensed (n=2). As shown, assume that a position where a point P1 on the belt is sensed by the belt position sensor 8*a* at a time t0 is a reference position d0. Then, a point P2 on the belt is sensed by the belt position sensor 8*a* at a time t1. At this time, assume that the belt is shifted upward from the reference position d0 by a displacement of Δ10. Subsequently, when the point P1 on the belt is brought to the position of the belt position sensor 8*b* at a time t2, a point P3 on the belt is sensed by the belt position sensor 8*a*. At this instant, by subtracting the value of the belt position sensor 8*a* output at the time t0 from the value of the belt position sensor 8*b* output at the time t2, there is produced a displacement or amount of meander Δ11 of the point P1 resulting from the movement of the belt.

When the belt is further moved until the point P2 arrives at the position of the belt position sensor 8*b* at a time t3, a point P4 on the belt is sensed by the belt position sensor 8*a*. In this case, the displacement calculator 110, FIG. 3, subtracts the value of the belt position sensor 8*a* output at the time t1 from the value of the belt position sensor 8*b* output at the time t3 for thereby producing a displacement or amount of meander Δ12 of the point P2 resulting from the movement of the belt. At this instant, because the point P2 has already been shifted from the reference position d0 by Δ10 at the position of the belt position sensor 8*a*, a displacement d2 from the reference position d0 is the sum of Δ10 and Δ12. The point P4 is also shifted from the reference position d0 by d2 from the reference position d0 at the position of the belt position sensor 8*a*.

Subsequently, assume that the belt is displaced downward in FIG. 6 and that the point P5 is sensed by the belt position sensor 8*a* at a time t4. Then, the displacement calculator 110, FIG. 3, subtracts the value of the belt position sensor 8*a* output at the time t2 from the value of the belt position sensor 8*b* output at the time t4 for thereby producing a displacement Δ13 of the point P5 resulting from the movement of the belt. Because the point P3 has already been shifted by Δ11 from the reference position d0 at the position of the belt position sensor 8*a*, a displacement d3 from the reference position d0 is equal to Δ11+(−Δ3)=Δ11−Δ13. Such a procedure is repeated at every point to be sensed thereafter in order to determine consecutive displacements from a reference position.

Figure 7:
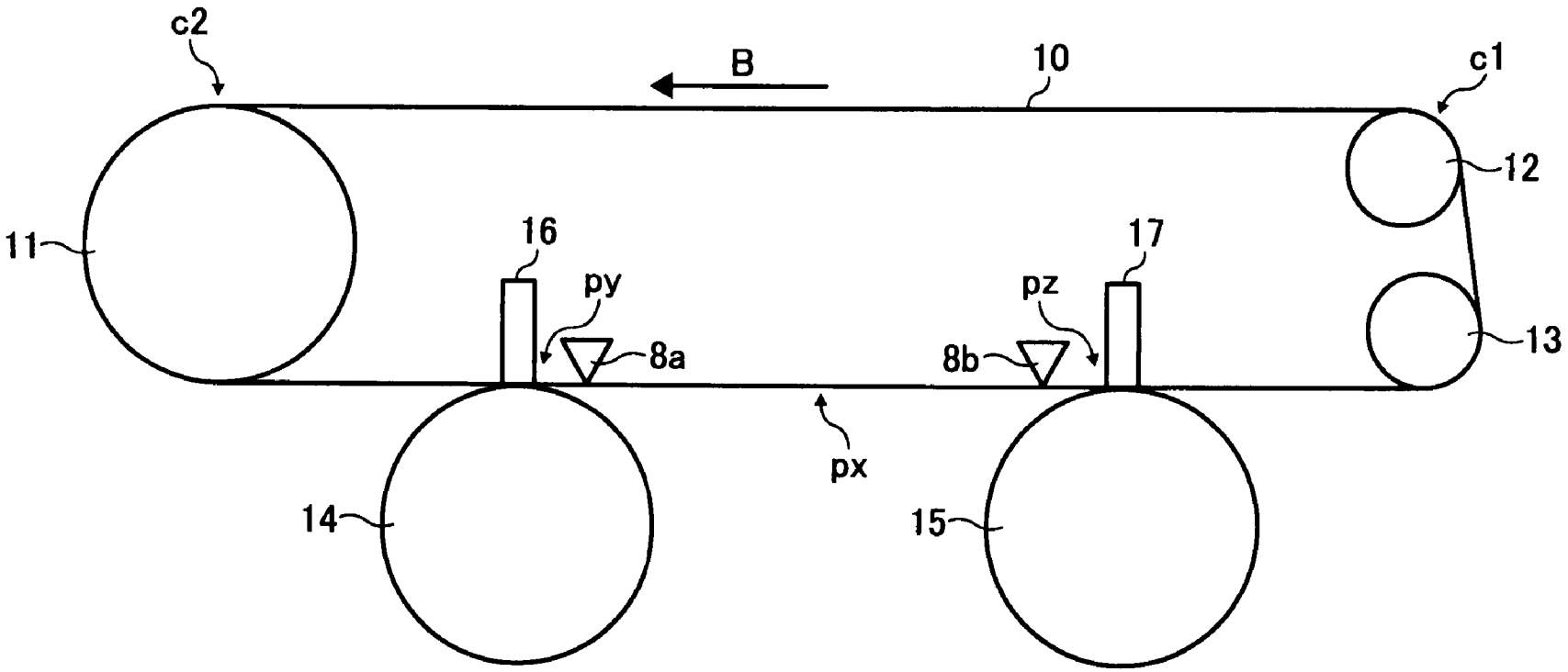
FIG. 7 is a view conceptually showing the intermediate image transfer belt included in the illustrative embodiment.

Referring to FIG. 7, the configuration of an endless belt or intermediate image transfer body included in the illustrative embodiment is shown. As shown, the belt, designated by the reference numeral 10, is passed over a drive roller 11 and driven rollers 12 and 13. Two photoconductive drums or image carriers 14 and 15 are held in contact with the belt 10 while being spaced from each other by a preselected distance. Two brushes 16 and 17 for primary image transfer, i.e., image transfer from the drums 14 and 15 to the belt 10 are located to face the drums 14 and 15, respectively, with the intermediary of the belt 10. Further, two belt position sensors 8*a* and 8*b* are positioned in the vicinity of the drums 14 and 15, respectively in the vicinity of the drums 14 and 15. In this configuration, the drums 14 and 15 and brushes for primary image transfer 16 and 17 allows the surface portions of the belt 10 adjoining the belt position sensors 8*a* and 8*b*, respectively, to oscillate little in the up-and-down direction.

If desired, the belt position sensors 8*a* and 8*b* may be respectively located in the vicinity of the driven roller 13 and drum 14, respectively. More specifically, at the upstream side of the driven roller 13, the oscillation of the driven roller 13 in the up-and-down direction B of the belt 10 is controlled by the drum 15 and image transfer brush 17. In addition, at the downstream of the driven roller 13, substantially no oscillation occurs because the free space of the belt 10 between the driven rollers 12 and 13 where the belt 10 is restricted only by rollers is short. By contrast, at a portion where the free space of the belt 10 is long, e.g., the portion between the drive roller 11 and the driven roller 12 shown in FIG. 7, the belt 10 is caused to oscillate in the up-and-down direction B, so that the shift of the belt 10 cannot be accurately determined if the belt position sensors are positioned at the above portion.

Figure 8:
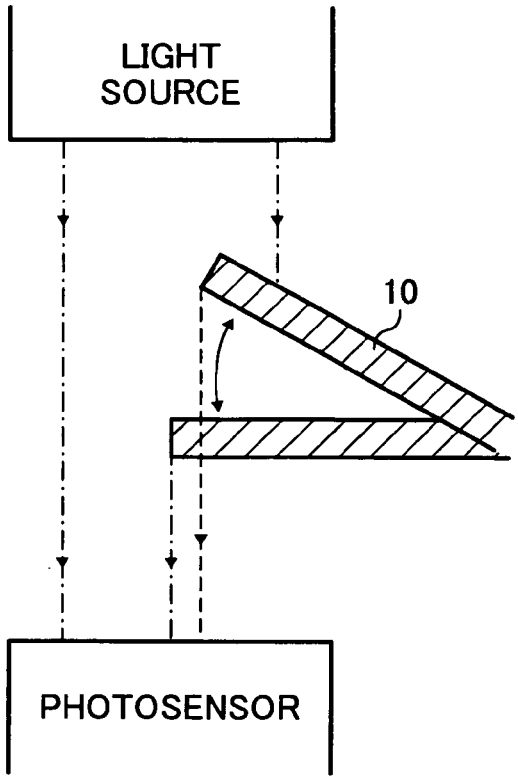
FIG. 8 is a view conceptually showing how the quantity of light transmitted through a photosensor varies due to the displacement of the belt.

It is to be noted that the oscillation of the belt 10 refers not only to oscillation ascribable to the movement of the belt 10 but also to the curl or similar deformation of the belt 10 itself. When use is made of a reflection type sensor, the quantity of light reflected by the sensor varies due to the oscillation of the belt 10, making the output of the sensor erroneous. Further, as shown in FIG. 8, when a transmission type sensor is used to sense the edge of the belt 10 as in the illustrative embodiment, any curl, for example, of the belt 10 causes the edge to oscillate in such a manner as to draw an arc about a point close to the center of the belt 10 with the result that the quantity of transmitted light, i.e., the quantity of light incident on the sensor varies, also making the sensor output erroneous. However, if the oscillation of the belt edge at the sensing position can be controlled by, e.g., a guide member contacting the belt, it is possible to reduce the variation of the quantity of light incident on a transmission type sensor and therefore to obviate erroneous sensing by locating the sensor at the above position.

Now, the displacement of the belt 10, as measured at any point in a single plane of the belt 10, is substantially equal to a displacement determined at a given point and shifted to the time domain. Therefore, as shown in FIG. 7, a displacement produced by advancing a displacement determined at a point px by a period of time tyx in the time domain is equal to a displacement at a point py while a displacement produced by retarding it by a period of time txz is a displacement at a point pz. The periods of time txz respectively refer to a period of time necessary for the belt 10 to move from the point py to the point px and a period of time necessary for the belt 10 to move from the point px to the point pz. This, however, holds only in an ideal condition wherein the belt 10 moves at a constant speed while a load acting on the belt 10 does not vary. Such an ideal condition is not available in practice.

In the illustrative embodiment, in order to accurately sense a belt displacement even when the belt speed, which is one of the two factors mentioned above, varies, a pair .of belt position sensors are assigned to a single drum or image carrier. For example, two pairs of belt position sensors or four pairs of belt position sensors are arranged if two drums or four drums, respectively, are used. With this arrangement, it is possible to reduce errors in the stored positions even if the belt speed varies, thereby allowing a belt displacement to be more accurately determined at an image transfer position assigned to each drum. Further, as for the variation of a load ascribable to the movement of an image transfer or that of a cleaning blade into or out of contact with the belt, it is possible to reduce the influence of the variation on the variation sensing side by locating the contact position at the non-sensing plane side of the roller, i.e., a point C1 or C2 shown in FIG. 7. Such a system, arranging respective belt position sensing means, is particularly desirable for a four drum, tandem image forming apparatus that uses a long image transfer belt.

Figure 9:
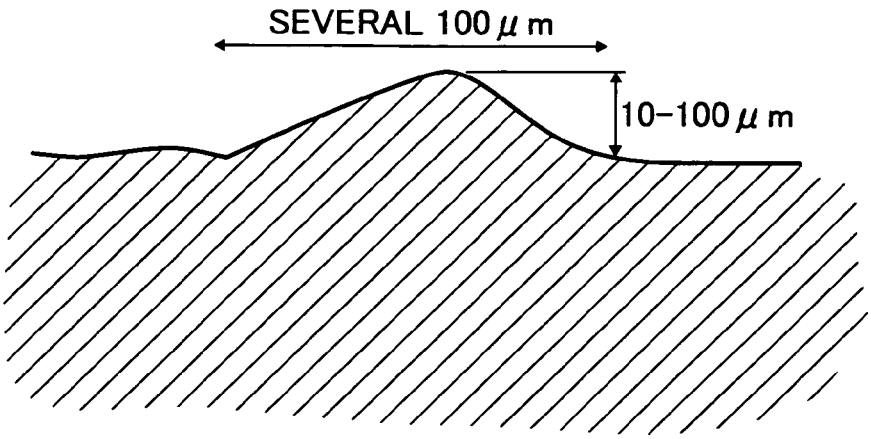
FIG. 9 is a fragmentary section showing a specific configuration of the belt edge.

FIG. 9 is a fragmentary section showing a specific configuration of the edge of the belt. As shown, a number of irregularities, extending over a length of several hundred micrometer with a height of several ten micrometers to a hundred micrometer each, exist on the edge of the belt although only one irregularity is shown. In this condition, if the moving or turning speed of the belt is not constant, a cumulative position error for a reference belt position increases with the elapse of time with the result that, even if the belt position is sensed at a preselected period from the mark position or reference position of the belt, the sensed position varies.

Further, if the moving or turning speed of the belt is not constant, each belt position sensor is likely to sense a projection or a recess existing at the edge of the belt at each time of sensing or sampling. It follows that even if a difference between sensor outputs is determined, as stated previously, the irregularity at the edge of the belt cannot be canceled.

Although the sensed position of the belt also varies when jitter exists in the sensor output or sampling signal, the jitter is as small as about 10 nanoseconds at the present stage and therefore does not give rise to the problems stated above. On the other hand, in order to reduce sensing errors ascribable to irregular belt speed, a plurality of marks, serving as a reference for the generation of the sampling signal, are provided on the belt, so that a new sampling signal is generated every time a mark is sensed. This is successful to reduce the cumulative position error ascribable to irregular belt speed and therefore irregularity in the sensed position of the belt. In the illustrative embodiment, the above marks are arranged on the belt in such a manner as to satisfy the following expression:

$$\text{distance between sensors} \times m = \text{distance between marks}$$

where m is a positive integer.

Every time a mark is sensed, a sampling signal generator, not shown, included in the image forming apparatus is initialized so as to generate a necessary number of sampling signals or pulses having a necessary period each. The distance between nearby marks is selected such that the influence of the cumulative belt position variation ascribable to irregular belt speed is negligible.

Figure 10:
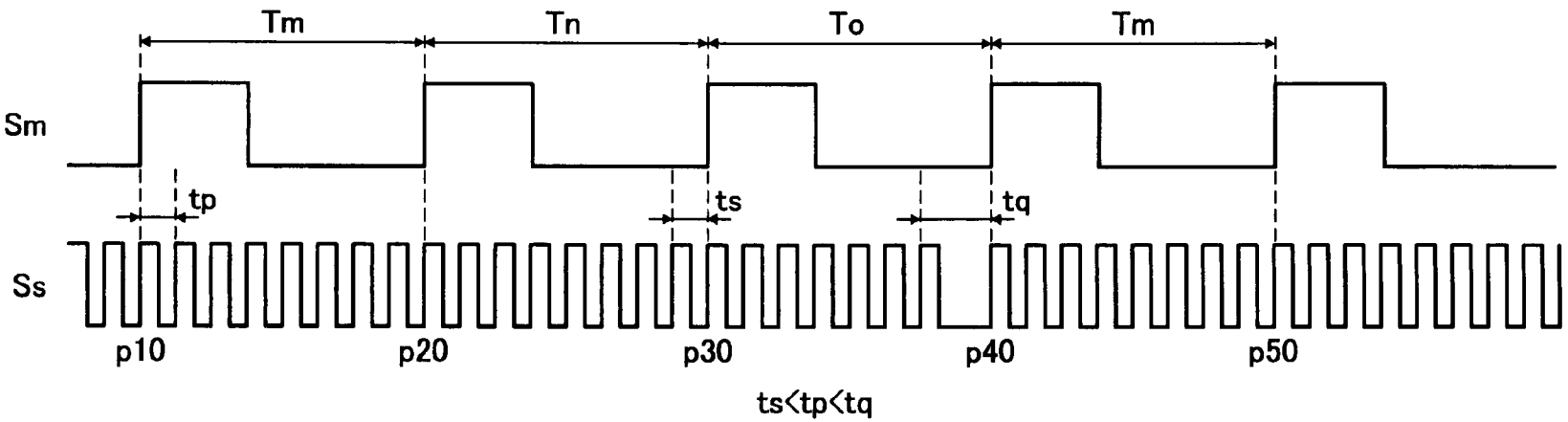
FIG. 10 is a timing chart showing a specific relation between a mark signal and a sampling signal.

FIG. 10 is a timing chart showing a specific relation between a mark signal and a sampling signal. In FIG. 10, m is assumed to be "8" while the distance between the belt position sensors or sensing means is assumed to be equal to the pitch of the positions of the belt to be sensed, i.e., n=1 for the sake of simplicity of illustration. As shown, when a mark signal Sm representative of a mark sensed is generated, the sampling signal generator is initialized and again caused to start counting a sampling period and a duty thereof for thereby generating a sampling signal Ss. More specifically, at the same time as the mark signal Sm goes high, the sampling signal generator generates eight sampling pulses Ss at a period of tp and then waits for the next mark signal Sm.

So long as the belt turns at constant speed, a period Tm between consecutive marks is equal to tp×8. Even if the belt speed is irregular and causes a relation of Tn<Tm<T0 and ts<tp<tq to hold, the sampling signal generator generates sampling pulses P10, P20, P30, P40 and P50 in synchronism with consecutive mark signals Sm, i.e., the same positions on the belt can be sensed at all times. In addition, the subsequent sampling pulses are influenced by the irregular belt speed little because a period of time that elapses after the sensing of a mark is short, reducing the errors of the positions sensed. Consequently, position errors are prevented from cumulating despite irregular belt speed, i.e., the sampling pulses Ss are newly generated in response to the next mark signal Sm, so that the influence of irregular belt speed and therefore the shift of sampling positions can be reduced.

Figure 11:
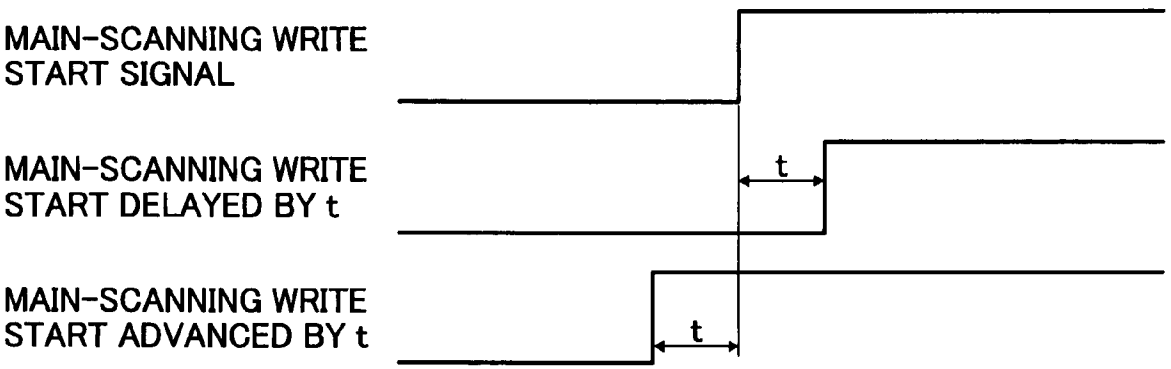
FIG. 11 is a timing chart showing a main-scanning write start signal, a main-scanning write start signal delayed by a scanning period of time of t and a main-scanning write start signal advanced by the period of time t.

FIG. 11 demonstrates how a position where image formation should be started in the main scanning direction is controlled in accordance with the displacement of the belt determined by the procedure described above. As shown, assume that a main-scanning write start signal (LGate) is generated in accordance with the displacement of a position detected for sensing a belt mark used as a reference position. Then, for a position displaced by an amount +d toward the center of the belt away from the reference position, the timing for generating the signal LGate, i.e., starting writing an image in the main scanning direction is delayed by a scanning period of time of t corresponding to the amount +d. On the other hand, for a position displaced by an amount −d toward the outside of the belt away from the reference position, the timing for generating the signal LGate is advanced by a scanning period of time of t corresponding to the amount −d.

As stated above, by starting image formation at the same position with respect to the belt edge, the illustrative embodiment reduces the displacement of images in the main scanning direction when they are superposed on each other. It is to be noted that because the spatial frequency of the detection of a displacement is far lower than image density, i.e., a scanning line pitch, writing control is executed on the basis of a displacement determined from a position or scanning line following a position where the above displacement has been determined to a position where the next displacement is to be determined.

Figure 12:
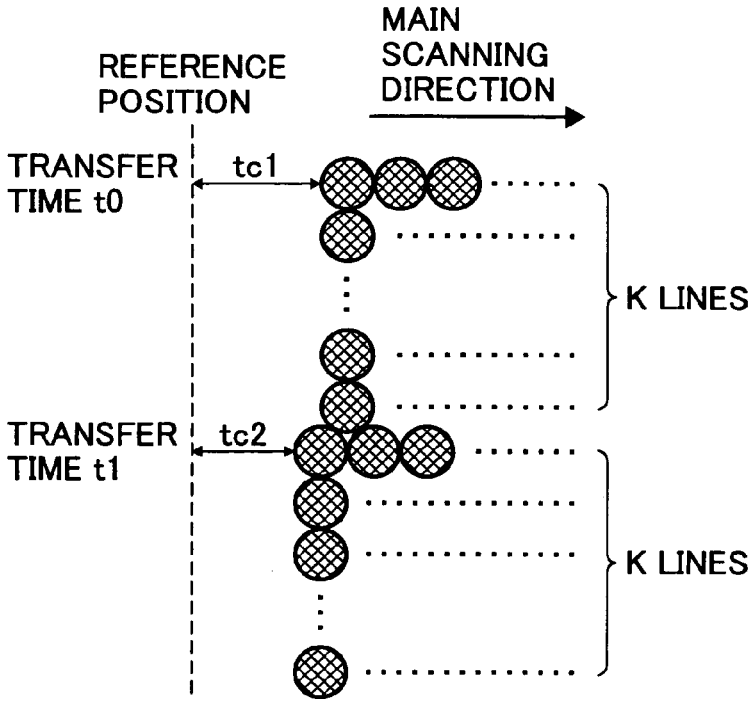
FIG. 12 is a view showing specific image formation start positions in the main scanning direction.

FIG. 12 shows specific write start positions in the main scanning direction. As shown, assume that a delay time for correcting a displacement from a reference position, as measured at the sensing position px of FIG. 7, i.e., at an image transfer time t0, is tc1 while a delay time for correcting a displacement from the reference position, as measured at the next sensing position py, i.e., at an image transfer time t1, is tc2. Then, the write timing is delayed by the period of time tc1 over k lines from the position px to the position py or delayed by the period of time tc2 from a position following the position py to a position where a displacement should be applied.

Figure 13:
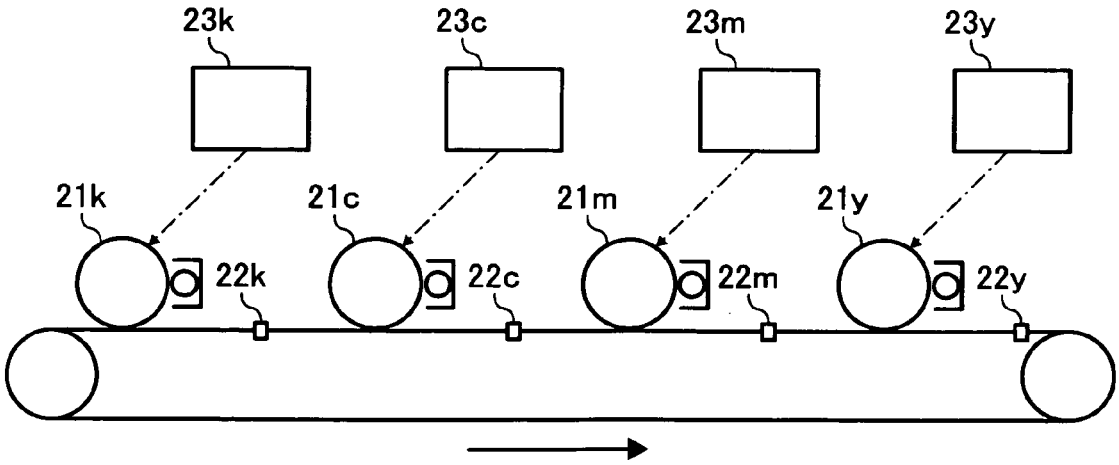
FIG. 13 is a view conceptually showing a four drum, tandem image forming apparatus.

FIG. 13 is a view conceptually showing the configuration of a four drum, tandem image forming apparatus. As shown, a pair of belt position sensors or sensing means 22*y*, 22*m*, 22*c* or 22*k* and a writing unit or writing means 23*y*, 23*m*, 23*c* or 23*k* is assigned to each drum or image carrier 21*y*, 21*m*, 21*c* or 21*k*, respectively. The belt position sensors 22*y* through 22*k* each are located at a position where a distance between it and an image transfer position and a distance between a writing position on the associated drum and the image transfer position are equal to each other. Each of the writing units 23*y* through 23*k* is configured to correct the main scanning start position independently of the others in accordance with the amount of meander determined on the basis of the outputs of the pair of belt position sensors assigned thereto. At this instant, the write start position in the main scanning direction is controlled by the above-described procedure on the drum basis such that a displacement from a preselected reference position is corrected.

It should be noted that the displacements of the belt occur with periodicity, i.e., variations that occur during one rotation of the belt are repeated. As for a single-drum, two-drum or similar tandem, color image forming apparatus configured to superpose images on a belt to form a color image by turning the belt a plurality of times, displacements or amounts of meander produced by the displacement calculator 110, FIG. 3, during one rotation of a belt beforehand by the above-described method are written to the storage 111, FIG. 3. More specifically, in the case of a two-drum color image forming apparatus, displacements relating to each drum and determined by the displacement calculator 110 beforehand are written to the storage 111 and then read out at the time of image formation in order to control the write start position by the method described above.

In summary, it will be seen that the present invention provides an image forming apparatus having various unprecedented advantages, as enumerated below.

(1) Displacements of an intermediate image transfer belt can be determined beforehand without being effected by the accuracy of the edge configuration of the belt or the positional errors of belt marks, reducing color shifts in the main scanning direction.

(2) It is not necessary to constantly measure the belt. In addition, belt marks can be easily provided on the belt.

(3) Displacements of the belt can be more accurately determined because the influence of the shift of the belt during movement is reduced.

(4) Displacements of the belt can be accurately determined on a drum or image carrier basis.

(5) The same points of the belt can be sensed at all times even when the belt speed is varied. This allows displacements of the belt to be accurately determined without regard the accuracy of the edge configuration of the belt or the positioning accuracy of belt marks.

(6) An image is formed at controlled write timing, so that color shifts ascribable to displacements of the belt are obviated.

(7) Image forming is executed in such a manner as to constantly correct displacements of the belt, also reducing color shifts in the main scanning direction.

(8) There can be obviated the deterioration of an image ascribable to, e.g., erroneous sensing.

Various modifications will become possible for those skilled in the art after receiving the teachings of the present disclosure without departing from the scope thereof.

What is claimed is:

1. An image forming apparatus for forming a superposed image by transferring an image formed on an image carrier to an intermediate image transfer belt, said image forming apparatus comprising:

a plurality of belt position sensors configured to sense a position of the intermediate image transfer belt in a direction perpendicular to a direction of movement of said intermediate image transfer belt each, said plurality of belt position sensors being located between rollers over which said intermediate image transfer belt is passed at positions different from each other in said direction of movement in a plane of said intermediate image transfer belt; and a displacement calculator configured to produce a difference between sensed values output by said plurality of belt position sensors at a plurality of any belt positions of the intermediate image transfer belt and then sequentially add said difference to a difference between sensed values output from said plurality of belt position sensors at belt positions different from said any belt positions for thereby determining a displacement of said intermediate image transfer belt in the direction perpendicular to the direction of movement.

2. The apparatus as claimed in claim 1, wherein nearby belt position sensors are spaced from each other by a distance which is an integral multiple of a pitch of measurement points arranged on the intermediate image transfer belt, and said displacement calculator adds a difference between values output from said belt position sensors with respect to any one of said measurement points to a difference between values output from said belt position sensors with respect to another measurement point upstream of said one measurement point in the direction of movement of said intermediate image transfer belt.

3. The apparatus as claimed in claim 1, wherein said belt position sensors each are located at or near a particular position where a contact member assigned to the intermediate image transfer belt faces said intermediate image transfer belt.

4. The apparatus as claimed in claim 1, wherein a plurality of marks are provided on the intermediate image transfer belt at a preselected distance which is an integral multiple of a distance between nearby belt position sensors, and a sampling signal of each of said belt position sensors is initialized every time said belt position sensor senses each of said marks.

5. The apparatus as claimed in claim 1, wherein an image formation start position in a main scanning direction is varied in accordance with a displacement of the intermediate image transfer belt calculated by said displacement calculator.

6. An image forming apparatus for forming a superposed image on an intermediate image transfer belt by transferring images formed on a plurality of image carriers to said intermediate image transfer belt one above the other, said image forming apparatus comprising:

a plurality of belt position sensors configured to sense a position of the intermediate image transfer belt in a direction perpendicular to a direction of movement of said intermediate image transfer belt each, said plurality of belt position sensors being located at or near positions where said image carriers and said intermediate image transfer belt contact each other; and a displacement calculator configured to determine a difference between values output from said belt position sensors with respect to a plurality of any belt positions of said intermediate image transfer belt and sequentially add consecutive difference to a difference between values output from said belt position sensors with respect to other belt positions different from said plurality of any belt positions beforehand for thereby determining a displacement of the intermediate image transfer belt in the direction perpendicular to the direction of movement of said intermediate image transfer belt.

7. The apparatus as claimed in claim 6, wherein a plurality of marks are provided on the intermediate image transfer belt at a preselected distance which is an integral multiple of a distance of nearby belt position sensors, and a sampling signal of each of said belt position sensors is initialized every time said belt position sensor senses each of said marks.

8. The apparatus as claimed in claim 6, wherein an image formation start position in a main scanning direction is varied in accordance with a displacement of the intermediate image transfer belt calculated by said displacement calculator.

9. An image forming apparatus for forming a superposed color image on an intermediate image transfer belt, which makes one turn, by transferring images formed on a plurality of image carriers to said intermediate image transfer belt one above the other, said image forming apparatus comprising:

a plurality of belt position sensors configured to sense a position of the intermediate image transfer belt in a direction perpendicular to a direction of movement of said intermediate image transfer belt each, said plurality of belt position sensors being located at or near positions where said image carriers and said intermediate image transfer belt contact each other;

a displacement calculator configured to determine a difference between values output from said belt position sensors with respect to a plurality of any belt positions of said intermediate image transfer belt and sequentially add consecutive differences to a difference between values output from said belt position sensors with respect to other belt positions different from said plurality of any belt positions beforehand for thereby determining a displacement of the intermediate image transfer belt in the direction perpendicular to the direction of movement of said intermediate image transfer belt; and a controller configured to control an image formation start position in a main scanning direction on each image carrier via a respective writing unit in accordance with the displacement of the intermediate image transfer belt determined with respect to said each image carrier.

10. An image forming apparatus for forming a superposed color image on an intermediate image transfer belt, which makes a plurality of turns, by transferring images formed on a plurality of image carriers to said intermediate image transfer belt one above the other, said image forming apparatus comprising:

a plurality of belt position sensors configured to sense a position of the intermediate image transfer belt in a direction perpendicular to a direction of movement of said intermediate image transfer belt each, said plurality of belt position sensors being located at or near positions where said image carriers and said intermediate image transfer belt contact each other;

a displacement calculator configured to determine a difference between values output from said belt position sensors with respect to a plurality of any belt positions of said intermediate image transfer belt and sequentially add consecutive difference to a difference between values output from said belt position sensors with respect to other belt positions different from said plurality of any belt positions beforehand for thereby determining a displacement of the intermediate image transfer belt in a direction perpendicular to a direction of movement of said intermediate image transfer belt;

a storage configured to store displacements of the intermediate image transfer belt determined by said displacement calculator when said intermediate image transfer belt completes one turn; and.

a controller configured to control an image transfer start position in the main scanning direction in accordance with the displacements stored in said storage.

* * * * *